United States Patent [19]

Shook et al.

[11] Patent Number: 5,024,382

[45] Date of Patent: Jun. 18, 1991

[54] SELF-ROTATING NOZZLE AND METHOD OF USE

[75] Inventors: Forrest A. Shook, Fenton; Terry L. Henshaw, Battle Creek, both of Mich.

[73] Assignee: NLB Corp., Wixom, Mich.

[21] Appl. No.: 273,396

[22] Filed: Nov. 18, 1988

Related U.S. Application Data

[63] Continuation-in-part of Ser. No. 175,805, Mar. 31, 1988, Pat. No. 4,821,961.

[51] Int. Cl.[5] ..... B05B 3/06; B05B 9/01

[52] U.S. Cl. ..... 239/11; 239/251; 239/259; 239/526

[58] Field of Search ..... 239/251, 253–261, 239/104, 526, DIG. 13, 11

[56] References Cited

U.S. PATENT DOCUMENTS

| | | | |
|---|---|---|---|
| 1,847,763 | 3/1932 | Keys | 239/251 |
| 2,590,726 | 3/1952 | Sawyer | 239/259 |
| 2,983,452 | 5/1961 | Lindbloom | 239/261 X |
| 3,598,316 | 8/1971 | Johnson | 239/251 |
| 3,748,050 | 7/1973 | Poppitz | 239/251 |
| 3,931,930 | 1/1976 | Waldrum | 239/253 X |
| 3,950,045 | 4/1976 | Hart | 384/129 |
| 3,987,963 | 10/1976 | Pacht | 239/252 X |
| 4,047,666 | 9/1977 | Hart | 239/251 |
| 4,747,544 | 5/1988 | Kränzle | 239/251 |
| 4,821,961 | 4/1989 | Shook | 239/526 X |

*Primary Examiner*—Andres Kashnikow
*Assistant Examiner*—William Grant
*Attorney, Agent, or Firm*—Dykema Gossett

[57] ABSTRACT

The self-rotating nozzle has a hollow shaft adapted for connection to a source of pressurized fluid. A body has an axial bore upon a central axis secured over one end of the shaft and has a counterbore. The shank with an end portion extends from the body into which the counterbore extends with the counterbore terminating in a pair of radial ports. A head bears against the body and is journaled upon the shank. A fastener upon the end portion retains the head against axial movement in one direction relative to the body. A fluid pressure chamber acts upon the head in the other direction. A pair of spaced jet flow orifices are mounted upon outer portions of the head extending generally parallel to the central axis but on oppositely extending axes canted at a small acute angle to axes parallel to the central axis to provide a balanced rotational reactive power torque to the head, there being a pair of fluid passages in the head communicating with the radial ports and with the orifices respectively, the orifices adapted to provide high velocity streams of fluid to a surface to be cleaned.

11 Claims, 2 Drawing Sheets

FIG. 1
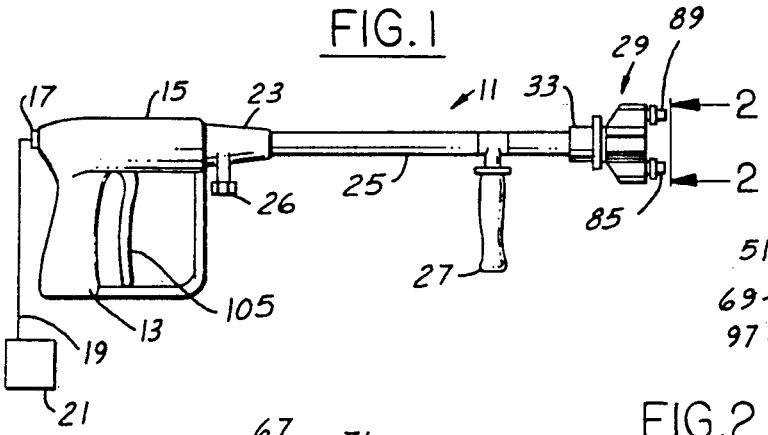
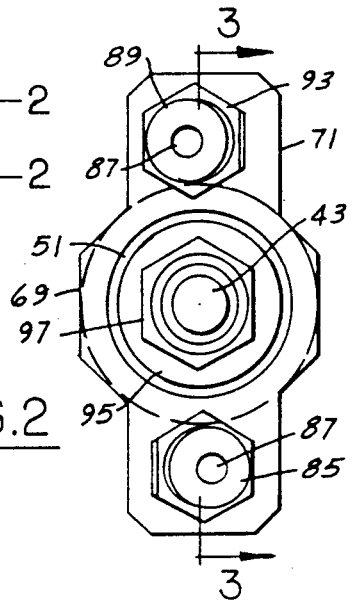
FIG. 2
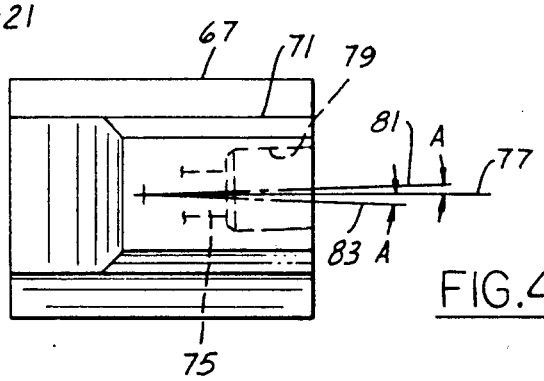
FIG. 4
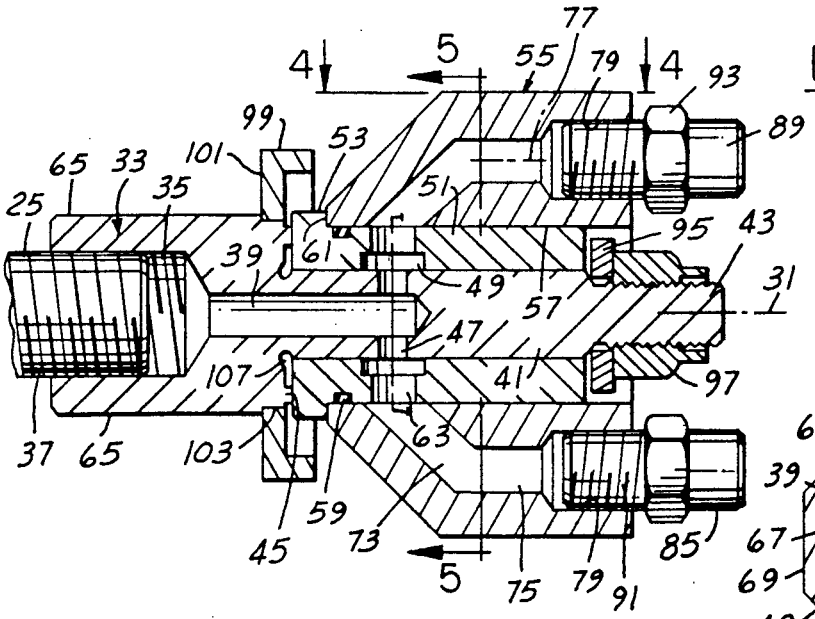
FIG. 3
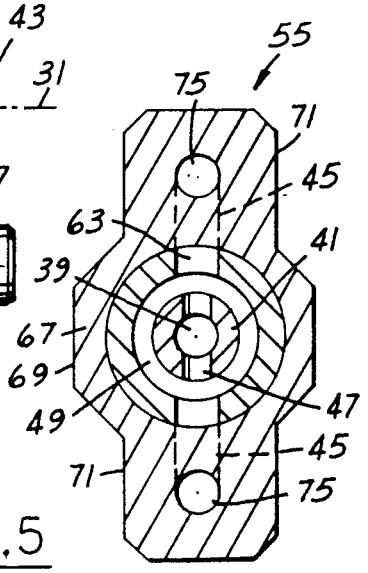
FIG. 5

SELF-ROTATING NOZZLE AND METHOD OF USE

This application is a continuation-in-part of our copending U.S. patent application, Ser. No. 07/175,805 filed Mar. 31, 1988 now U.S. Pat. No. 4,821,961.

FIELD OF INVENTION

The invention relates to hand-held rotative nozzles for delivering high-pressure, high-velocity fluids for impingement upon a surface to be cleaned.

SUMMARY OF THE INVENTION

The present invention relates to a self-rotating nozzle or nozzle assembly which is to be used on the end of a hand-held cleaning gun or lance for improving the speed or quality of cleaning a surface.

It is a feature of the present invention to provide an improvement in a self-rotating nozzle having a spinning head with a pair of orifices adapted for continuous rotation throughout 360 degrees.

Another feature of the present invention is the provision of a self-rotating nozzle in which the spinning head has a pair of orifices adapted to be mounted upon a lance thereby improving the speed and/or quality of cleaning over a device using a single jet.

Still another feature of the present invention is the provision of a self-rotating nozzle of the aforementioned type wherein the spinning head is adapted for rotation at, as an example, 3000 to 5000 RPM and for delivery of high-velocity fluids upon a surface to be cleaned at working pressures in the range of 10,000 to 20,000 PSI.

A further feature of the present invention is the provision of a self-rotating nozzle of the aforementioned type in which the orifices are mounted upon outer portions of the spinning head generally parallel to the central axis of rotation but on oppositely extending axes included at an acute angle to axes parallel to the central axis of rotation of the head to thereby provide a self-rotating nozzle having a balanced rotational reactive power torque to the spinning head.

A further feature of the present invention is the provision of a self-rotating nozzle that includes a rotating head that is mounted to be freely rotatable upon a fixed shank. The high-velocity fluid will exit the rotating head at an acute angle from a longitudinal axis of the overall device and will impart motion to the rotating head. Since the rotating head is freely rotatable, it will rotate at a speed that approximates the transverse component of the velocity of the exiting fluid, thus leaving only a longitudinal component of this high velocity that will create an approximately cylindrical fluid jet surface.

A still further feature of the present invention is the provision of a self-rotating nozzle which is simple in construction, efficient in operation, and is economical to manufacture and to maintain.

These and other features and objects will be seen from the following specification and claims in conjunction with the appended drawings.

THE DRAWING

FIG. 1 is a side elevational view of the present self-rotating nozzle upon the end of a hand-held wand with pressurized hydraulic connections schematically shown.

FIG. 2 is an end view taken in the direction of arrows 2—2 of FIG. 1, on an increased scale.

FIG. 3 is a longitudinal section of the present self-rotating nozzle shown in FIG. 1, on an increased scale for clarity.

FIG. 4 is a fragmentary plan view taken in the direction of arrows 4—4 of FIG. 3.

FIG. 5 is a vertical section taken in the direction of arrows 5—5 of FIG. 3.

Figure 6:
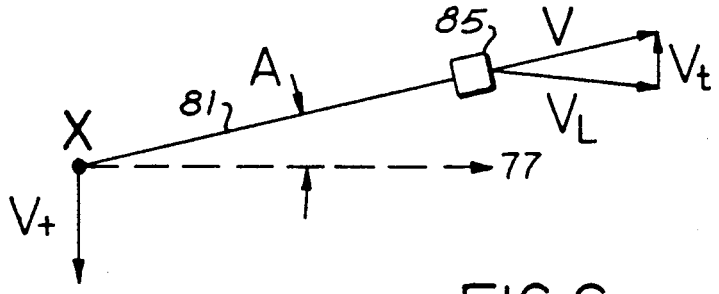
FIG. 6 is a velocity-vector diagram that illustrates an important feature of the invention.

It will be understood that the above drawings illustrate merely a preferred embodiment of the invention, and that other embodiments are contemplated within the scope of the claims hereafter set forth.

DETAILED DESCRIPTION OF AN EMBODIMENT OF THE INVENTION

A water blaster, apparatus or gun 11 is shown in FIG. 1 for mounting and supporting a self-rotating nozzle assembly 29 according to the present invention, to provide high-velocity streams of fluid upon a surface to be cleaned. The apparatus 11 includes a support grip 13 with overlying pressure chamber 15 having hose fitting 17 adapted for connection to a pressure hose 19 extending from pump and tank assembly 21, schematically shown in FIG. 1. The pump and tank assembly 21 includes a pump and a reservoir for delivering fluid, such as water, at pressures up to 20,000 PSI.

Pressure chamber 15 terminates in an outlet fitting 23 into which projects one end of a lance, wand or hollow shaft 25 which is suitably secured thereto, as by set screw 26 or other fastener.

Mounted upon the other end of the shaft or lance 25 is the present self-rotating nozzle or nozzle assembly 29 having a longitudinal central axis of rotation 31, FIG. 3. The lance or support shaft 25 includes a depending handle 27 intermediate its ends which in conjunction with grip 13 provides a means for manually supporting the lance or hollow shaft 25 and for directing streams of pressurized fluid outwardly from the self-rotating nozzle assembly 29.

The nozzle assembly 29 includes a body 33 constructed of stainless steel having at one end an axial threaded bore 35 adapted to receive the threaded end 37 of shaft 25, fragmentarily shown, FIG. 3, and shown in assembly in FIG. 1. Threaded bore 35 terminates in an elongated counterbore 39 arranged upon the central axis 31. One end of body 33 terminates in an elongated shank 41, FIG. 3, into which projects one end of the counterbore 39. Shank 41 at one end terminates in a threaded end 43.

Body 33 at one end terminates in an annular stop flange 45. Counterbore 39 adjacent one end terminates in opposed radial ports 47. The ports 47 communicate with an annular channel 49 upon the interior of bushing 51. Bushing 51 is rotatably journaled upon the shank 41 and includes an annular stop flange 53 in engagement with the annular stop flange 45. Bushing 51 is axially projected into and secured within head 55 or pressed therein. The head 55 is constructed of stainless steel.

The rotatable head 55 includes axial bore 57 into which bushing 51 may be projected and secured with an O-ring seal 59 interposed. Instead of the O-ring 59, there could be employed a sealing composition both forward and aft of the cross-drilled ports 63 within the bushing 51. Preferably, the members are simply press-fit together.

Head 55 at one end has an annular end face 61 in snug registry with flange 53 of bushing 51. The respective radial ports 47 communicating with counterbore 39 are in registry with annular channel 49 upon the interior of bushing 51. A pair of radial ports 63 extend from the annular channel 49 to the exterior of bushing 51 and are adapted for communication with the respective top and bottom orifices 89 and 85, FIG. 3. To facilitate mounting and anchoring of body 33 upon the wand 25, there are applied to opposite sides thereof a pair of conventional wrench-engaging flats at an axial position on the body 33 identified by the numeral 65, FIG. 3.

Head 55, rotatable upon axis 31, includes a central portion 67, FIG. 5, having a pair of opposed wrench-engaging flats 69 and a pair of diametrically opposed, outwardly-extending wings 71 which mount the respective orifices 85 and 89. Within central portion 69 of head 55 are a pair of angular passages 73, in the illustrated embodiment inclined at a 45 degree angle to axis 31. Passages 73 at their inner ends communicate with outboard radial ports 63 within bushing 51. The outer ends of angular passages 73 terminate in axial passages 75 located within wings 71. Passages 75 are arranged upon longitudinal axes 81, 83 which are slightly canted with respect to an axis 77 that is parallel to central axis 31, each passage 75 terminating in an enlarged interiorly threaded nozzle counterbore 79, FIG. 3.

As shown in FIG. 4, each of the respective counterbores 79 is arranged upon the oppositely extending lateral axes 81 and 83, canted in the illustrated embodiment at an angle "A" of 1.7 degrees, approximately, relative to axis 77. The acute angle "A" is preferably in the range of 1 to 3 degrees, approximately. Threaded bores 79 and passages 75 are generally parallel to the central axis 31, but are actually slightly canted by a very small angle "A," and the bore 79 that receives the orifice 85 is oppositely canted with respect to the bore 79 that receives orifice 89. Due to this opposite arrangement of the canted angles, the rotating head 55 is provided with a balanced rotational reactive power torque. Bottom orifice 85 with a suitable fluid outlet 87 has a threaded shank 91 which is threaded into the corresponding lower threaded bore 79, as shown in FIG. 3. Top orifice 89 has a similar fluid outlet 87, and a corresponding threaded shank 91 is threaded into the top threaded bore 79, FIG. 3. Each of the respective orifices 85, 89 have intermediate their ends a hex nut 93 as a part thereof to facilitate threading and securing to the respective wings 71 forming a part of the rotative head 55.

In the assembly shown in FIG. 3, apertured end plate 95 is mounted over the inner end of threaded end 43 of shank 41, is spaced from one end of bushing 51 and is retained on the threaded end 43 by adjustable fastener or nut 97.

Annular fluid deflector 101 is mounted against the shoulder 103 formed adjacent one end of body 33 and includes an axial annular flange 99 which extends over annular stop flange 53 forming a part of bushing 51. Annular stop flange 45 at one end of body 33 in cooperation with annular stop flange 53 and bushing 51 defines a pressure chamber 107. Outletting pressurized fluids, such as water, pass radially outward through radial ports 47 for direction to the annular passage 49 in bushing 51 and through radial ports 63 to passages 73 and 75 for supplying pressurized fluid to the respective nozzle orifices 85 and 89. The fluid converts the high pressure into high velocity as it exits the nozzle.

Since there is some limited spacing between the rotatable bushing 51 upon head 55 with respect to shank 41, the pressurized fluid passes upon the bore of bushing 51 moving into pressure chamber 107 to create an axial fluid bearing that normally biases bushing 51 axially outward. Additional pressurized fluid passes in the opposite direction between shank 41 and bushing 51 to lubricate bushing 51 during its rotation with respect to the shank 41. No packing is required. Any pressurized fluid which escapes from pressure chamber 107 moves radially outward into fluid deflector 101 for projecting axially forward towards the rotating head 55.

Due to the angular opposing relationship of the respective orifices 85 and 89 with respect to corresponding central axes 77 parallel to central axis 31, there is established upon flow of fluids through the orifices a rotational reactive power torque to head 55 for rotation about axis 31 and with respect to shank 41 upon body 33. Due to the unique, low-friction mounting of the head, even a partial flow of fluid will serve to begin rotating the nozzle.

The respective fluid passages 73 and 75 within the head communicate with the radial ports 63 in the bushing 51 and further communicate with the respective orifices 85 and 89 to provide high-velocity streams of fluid upon a surface to be cleaned. In the illustrated embodiment, fluids up to 20,000 PSI are utilized. The self-rotating nozzle assembly rotates at full speed at approximately 3000 RPM. Also, both sets of fluid passages 73, 75 and the bores 79 are all located in a single body portion; that is, there is not a separate body portion for each set of fluid lines leading to one of the respective orifices 85, 89.

An important feature of the present invention can be best understood from the velocity diagrams illustrated in FIG. 6. FIG. 6 illustrates the velocity of the rotating head 55 and the velocity of the fluid exiting the orifice 85. As can be seen from FIGS. 6 and 4, the axes 81, 83 are drawn transverse to an axis 77 beginning from a point X that is approximately in the position where the passages 75 meet the passages 73. The high-velocity fluid leaving the orifice 85 exits at a velocity V that can be described as the combination of two vectors $V_L$, which is the longitudinal component of the velocity V, and $V_T$, which is a tangential component of the velocity V.

A reactive force is applied to the rotating head 55 at point X that is opposite to the force of the velocity V. At point X, there is an equal and opposite force to $V_L$ and $V_T$. The $V_T$ component is the force that causes the head to rotate with respect to the shank 41, and the $V_L$ component forces the rotating head rearwardly, as seen in FIG. 3, but is counterbalanced by the pressure existing in the balance pressure chamber 107. Due to the unique mounting system of the rotating head 55, there is very little friction between the head 55 and the shank 41. This allows the head 55 to rotate, as indicated by arrows 151 in FIG. 7, at a speed that is very nearly equal to the speed $V_T$ of the exiting fluid. That is, since the frictional forces applied to the head are so low, almost the entire force resulting from the $V_T$ component of the exiting velocity will be translated into rotational force applied to the head 55.

Since the tangential velocity of orifice 85 is approximately equal to the tangential velocity of the fluid $V_T$ and is in the opposite direction, the rotation of the head will tend to cancel out this tangential component of the exiting fluid velocity. As a result, the absolute velocity of the fluid leaving the nozzle is simply the $V_L$ component of V. Due to this, the fluid leaves almost directly parallel to axes 77 and 31, and the jet of fluid creates an imaginary cylindrical body, shown as 150 in FIG. 7, that will apply very high force to any surface that needs to be cleaned. The cylindrical body 150 will have a diameter D equal to the distance between the orifices 85, 89.

In similar devices, it was necessary to have a tangential component of the exiting fluid velocity $V_T$ since that is what applies the rotation to the head; however, the prior art rotational speeds did not approximate the velocity $V_T$ of the exiting fluid. Due to this, the fluid exiting has an absolute velocity that still contained a large portion of the $V_T$ component, and thus the prior art rotating heads could not create a cylindrical jet of fluid. The prior art fluids jet expanded conically and dispersed.

By achieving a cylindrical jet of fluid, the present invention allows an operator to clean a surface from a distance much greater than would be possible with the prior art rotating heads, and at the same time clean the surfaces more efficiently and much quicker.

Figure 7:
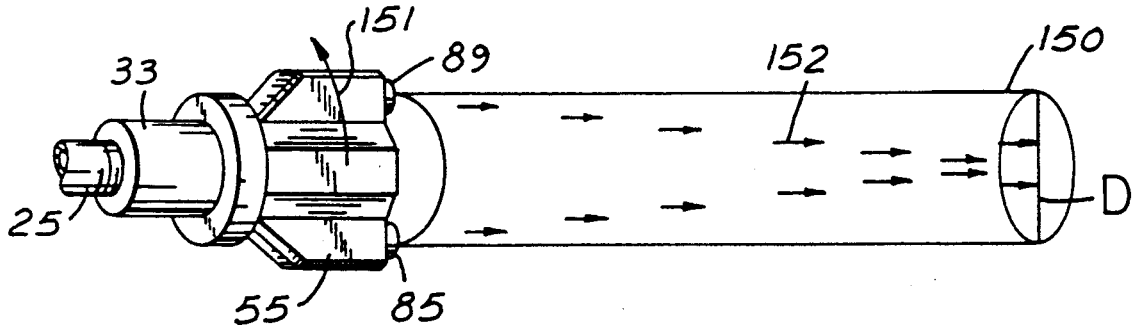
FIG. 7 is a perspective view of the self-rotating nozzle of the present invention.

For clarity, it is to be understood that the imaginary cylindrical surface 150 is actually comprised of the two jets, shown by arrows 152 in FIG. 7, exiting the orifices 85 and 89 in a direction almost directly parallel to the axis 31. Since the head 55 is rotating at such a great speed, these two jets would appear to be a cylindrical body of water.

The present self-rotating nozzles when normally arranged upon one end of a cleaning gun or lance, such as shown at 25, improves the speed and quality of cleaning over the use of a single stationary jet.

The nozzle assembly 29 can be affixed to any high pressure cleaning lance, it preferably requires an inlet connection of ½ inch NPT piping. A disclosed embodiment may weigh 1 lb. 6 oz., is 3.8 inches long The present invention provides a method of removing paint, rust or scale from a surface by applying an almost cylindrical jet of fluid to the surface. By keeping the jet cylindrical, the present invention avoids dispersion of the jet and achieves a concentrated jet that works effectively in removing materials.

Having described my invention, reference should now be had to the following claims.

We claim:

1. A method of cleaning a surface to be cleaned by a high-velocity rotational jet of fluid, comprising:

mounting a rotating head upon a fixed shank in such a way that it is freely rotatable upon the fixed shank;

forming passages through the fixed shank, through the rotating head and into two nozzles attached to the head;

canting the nozzles with respect to a longitudinal axis; and allowing high-pressure fluid to go through said passages in the shank into said passages in the rotating head, and out the fluid nozzles, thus changing the fluid into a high-velocity fluid with both a longitudinal component and a transverse component, the tranverse component being converted as a reactive force to the rotating head, causing the rotating head to rotate, the mounting of the rotating head upon the shank allowing the rotating head to rotate at a speed that approximates the transverse component of the fluid velocity:

the rotation of the rotating head at a speed that approximates the transverse component of the fluid velocity causing the rotating head to rotate in the opposite direction as the fluid and to cancel out the transverse component of the fluid velocity, thus creating a fluid jet that is nearly longitudinal and results in a nearly cylindrical jet of water being applied to the surface to be cleaned.

2. A method of cleaning a surface as recited in claim 1, and further wherein the rotating head being provided with at least one axial fluid bearing that acts to balance the forces applied to the rotating head in the direction of the fluid bearing, the axial fluid bearing resulting in the rotating head being freely rotatable and of low frictional interference with the fixed shank.

3. A method of cleaning a surface as recited in claim 2, and further wherein the passages in the rotating head includes an annular cylindrical passage that communicates the fluid from the shank to the rotating head and also serves as part of the freely rotating mounting between the rotating head and the shank.

4. A method of cleaning a surface as recited in claim 1, and further wherein the passages in the rotating head and the nozzles are formed in one-piece integral body.

5. A self-rotating nozzle, comprising:

a hollow shaft adapted for connection to a source of pressurized fluid;

a body having an axial bore upon a central axis secured over one end of said shaft and having a counterbore;

a shank extending from said body in which said counterbore extends;

said counterbore terminating in a pair of opposed radial ports;

a pair of spaced jet flow orifices mounted upon outer portions of said head extending generally parallel to a central axis of said shank but on oppositely extended canted axes with respect to said central axis to provide a balanced rotational reactive power torque to said head;

passages connecting said radial ports to said orifices;

the head being freely mounted upon the shank so that any transverse component of the velocity of fluid leaving the jet flow orifices will be transmitted into rotational force applied to the rotating head such that the head rotates at a speed that approximates the transverse component of the velocity of the fluid jet, thus resulting in the fluid jets exiting the jet flow orifices in a way such that they create a cylindrical body of water that can be applied to a surface to be cleaned; and wherein both said passages and orifices are formed in a one-piece integral body and said orifices are in a fixed angular orientation with respect to said central axis.

6. A self-rotating nozzle as recited in claim 5, and further wherein said head is comprised of a head bearing portion that is mounted upon said shank for rotatably guiding said head upon said shank, a first axial fluid bearing surface being provided at one axial extent of said bearing and the rotative mounting of said bearing upon said shank being such that fluid is allowed to communicate with the area between the two members so as to provide a second fluid bearing surface between the two which communicates fluid to said first axial fluid bearing surface and thus allow the freely rotatable mounting of said head upon said shank.

7. A self-rotating nozzle comprising a hollow shaft adapted for connection to a source of pressurized fluid;

a body having an axial bore upon a central axis secured over one end of said shaft and having a counterbore;

a shank extending from said body in which said counterbore extends;

said counterbore terminating in a pair of opposed radial ports;

an end portion on one end of said shank;

a head bearing against said body and journaled upon said shank for rotation upon the central axis;

fastener means upon said shank end portion retaining said head against axial movement in one direction relative to said body;

a pair of spaced jet flow orifices mounted upon outer portions of said head extending generally parallel to said central axis but on oppositely extending axes inclined at a small acute angle to axes parallel to said central axis to provide a balanced rotational reactive power torque to said head;

there being a pair of fluid passages in said head at their one end communicating with said radial ports and their other end communicating with said orifices respectively, said orifices adapted to provide high-velocity streams of fluid upon a surface to be cleaned;

both said fluid passages being formed in a single, integral body portion; and said orifices being in a fixed angular orientation with respect to said central axis.

8. A body member for use as a rotating head in a rotating nozzle device comprising:

a body portion having an internal bore:

a bearing portion mounted within said internal bore of said body portion, said bearing portion being formed with an internal cylindrical bore:

at least one nozzle being mounted in said body portion:

fluid passages extending from the internal bore of said bearing portion through the body portion to said nozzle;

said bearing portion being formed with an internal annular cylindrical channel at its inner periphery thereof and two ports which extend from said annular channel to the outer periphery of said bearing portion;

said body portion being formed with two angled passage portions that communicate with said two ports and said bearing portion and which extend outwardly and forwardly in the body portion; and axial flow passages extending within the body portion to communicate the angled passages to the nozzles.

9. A body member as recited in claim 8, and further wherein said axial passages and said nozzle are both slightly canted with respect to a central axis of said head.

10. The method of rapidly removing a heavy build-up of material such as paint, rust or scale from a surface using high velocity water jetting technology effective at pressures up to 20,000 PSI comprising the steps of:

taking a high pressure cleaning lance and mounting a self-rotating head upon it, said self-rotating head having one or more nozzles;

locating the nozzles in close proximity to the surface to be cleaned and actuating the lance thereby rotating the head and directing the high velocity water from the nozzle against the surface to remove the build-up;

said self-rotating head being affixed to said high-pressure cleaning lance in such a way that said self-rotating head rotates at a velocity that approximates the transverse component of the exiting water velocity so that the relative velocity of the exiting water will be essentially a longitudinal component thereof, thus creating a cylindrical body of high-velocity water jet.

11. A self-rotating nozzle comprising:

a hollow shaft adapted for connection to a pressurized fluid;

a body having an axial bore upon a central axis secured over one end of said shaft, and having a counterbore;

a shaft extending from said body in which said counterbore extends;

said counterbore terminating in at least one inner radial port;

an end portion on one end of said shank;

a head bearing against said body and journaled upon said shank for rotation upon the central axis;

fastener means upon said shank end portion retaining said head against axial movement in one direction relative to said body;

at least one jet flow orifice mounted upon outer portions of said head extending generally parallel to said central axis but inclined at a small acute angle to an axis parallel to said central axis to provide a rotational reactive power torque to said head;

at least one set of fluid passages in said head communicating with said orifice, said orifice adapted to provide high-velocity streams of fluid upon a surface to be cleaned;

an annular flange projecting from said body and secured thereto, a fluid pressure chamber disposed between said body and said rotational head at a second direction relative to said body;

said annular flange having an axially extending outer portion that extends axially over a portion of said rotational head and axially covering said fluid pressure chamber such that any fluid escaping from said fluid pressure chamber will be deflected by said axially extending flange in the direction toward the surface to be cleaned.

* * * * *